United States Patent [19]

Hallman et al.

[11] 4,124,987

[45] Nov. 14, 1978

[54] PILING RIGS

[75] Inventors: Philip J. Hallman, St. Albans; Harold W. Lawrence, Bromley, both of England

[73] Assignee: National Research Development Corporation, London, England

[21] Appl. No.: 806,473

[22] Filed: Jun. 14, 1977

[30] Foreign Application Priority Data

Jun. 16, 1976 [GB] United Kingdom ..... 24944/76

[51] Int. Cl.[2] ..... E02D 7/02; G10K 11/00

[52] U.S. Cl. ..... 405/276; 173/DIG. 2; 181/200; 181/205; 405/232

[58] Field of Search ..... 181/200, 205; 173/DIG. 2; 61/53.5, 63, 53

[56] References Cited

U.S. PATENT DOCUMENTS

| | | | |
|---|---|---|---|
| 3,750,765 | 8/1973 | Shelbourne et al. | 173/DIG. 2 |
| 3,975,918 | 8/1976 | Jansz | 61/53.5 |

FOREIGN PATENT DOCUMENTS

| | | | |
|---|---|---|---|
| 556,954 | 4/1973 | Switzerland | 61/53.5 |
| 1,419,071 | 12/1975 | United Kingdom | 61/53.5 |

*Primary Examiner*—Mervin Stein
*Assistant Examiner*—Alex Grosz
*Attorney, Agent, or Firm*—Cushman, Darby & Cushman

[57] ABSTRACT

A piling rig comprises two sound-reducing enclosures arranged one over the other. In use the bottom enclosure is arranged around a row of piling and the top enclosure surrounds the piling hammer as it moves along the row of piling for pile-driving or pile-extraction purposes.

9 Claims, 3 Drawing Figures

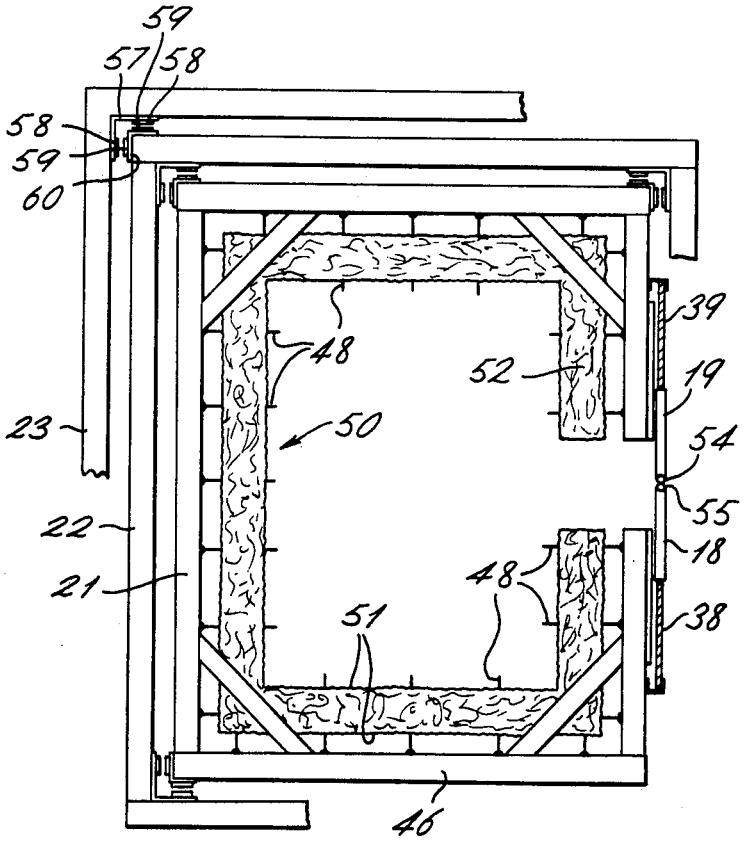
Fig. 2
Fig. 3
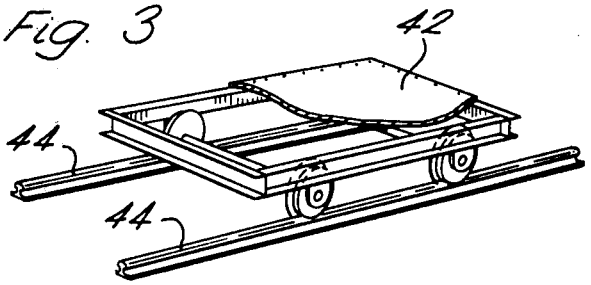

PILING RIGS

The present invention relates to piling rigs and in particular to piling rigs including means for reducing the noise emitted from the rig during piling.

Piling rigs have already been proposed in which the noise emission is reduced by enclosing the pile driver and at least a part of the pile within a sound reducing casing.

In most cases only the pile driver and the top of the pile has been enclosed in this way but it has also been proposed to enclose the pile driver and pile right down to ground level by means of a box-like structure.

The pile driver in this latter case is permanently housed within the structure during use and successive piles to be driven are introduced through a door in one wall of the structure. Apart from negligible openings in the structure e.g. an aperture in the top surface to allow passage of a control cable for the pile driver, the casing completely encloses the pile driver and pile.

According to the present invention, a rig for use in driving and/or extracting piles comprises a first sound-reducing enclosure apertured to allow a pile to project above the upper surface of said first enclosure, and a second sound-reducing enclosure mounted for movement over the top of the first enclosure and apertured to accept that portion of the pile projecting above the first enclosure.

Preferably the first enclosure is of a generally elongate shape with its length disposed horizontally, and the second enclosure is movable along the length of the first enclosure from a region at one end of the first enclosure to a region at the other end. In one such embodiment, for example, the first enclosure has on its upper surface a track determining the line of motion of the second enclosure.

According to a preferred feature, the second enclosure includes two doors adapted to close against one another or to close on the opposite faces of a pile adjacent to the pile or piles currently being driven or extracted.

The second enclosure may be collapsible so as to be able to expand or contract vertically as desired. As this allows the pile driver to be surrounded always by the same portion of the second enclosure, this feature has the advantage of giving maximum effectiveness to any additional sound-proofing confined to this portion. Thus in one embodiment where the second enclosure has a telescopic construction, the uppermost module of the telescopic construction is preferably additionally sound-proofed as compared with the other modules of the construction.

The rig of the present invention is especially suited to use with a row of sheet piling and according to another feature of the invention, the rig may include, within the volume of the first enclosure, means for supporting the piling at the desired inclination (usually upright) during at least the topmost part of the motion of the individual piles.

The support means may, for example, take the form of one or more pairs of "gates", the gates of each pair being arranged one on each side of the vertical center plane of the rig and movable towards and away from that plane. In this latter respect, it is advantageous if at least the upper gates can be sufficiently separated to allow the pile driver to pass between them if desired.

An embodiment of the invention will now be described, by way of example only, with respect to the accompanying drawing in which:

FIG. 2 shows, on an enlarged scale, a fragmentary plan view of the top part of the rig; and FIG. 3 shows, also on an enlarged scale, a perspective view of another part of the rig.

Figure 1:
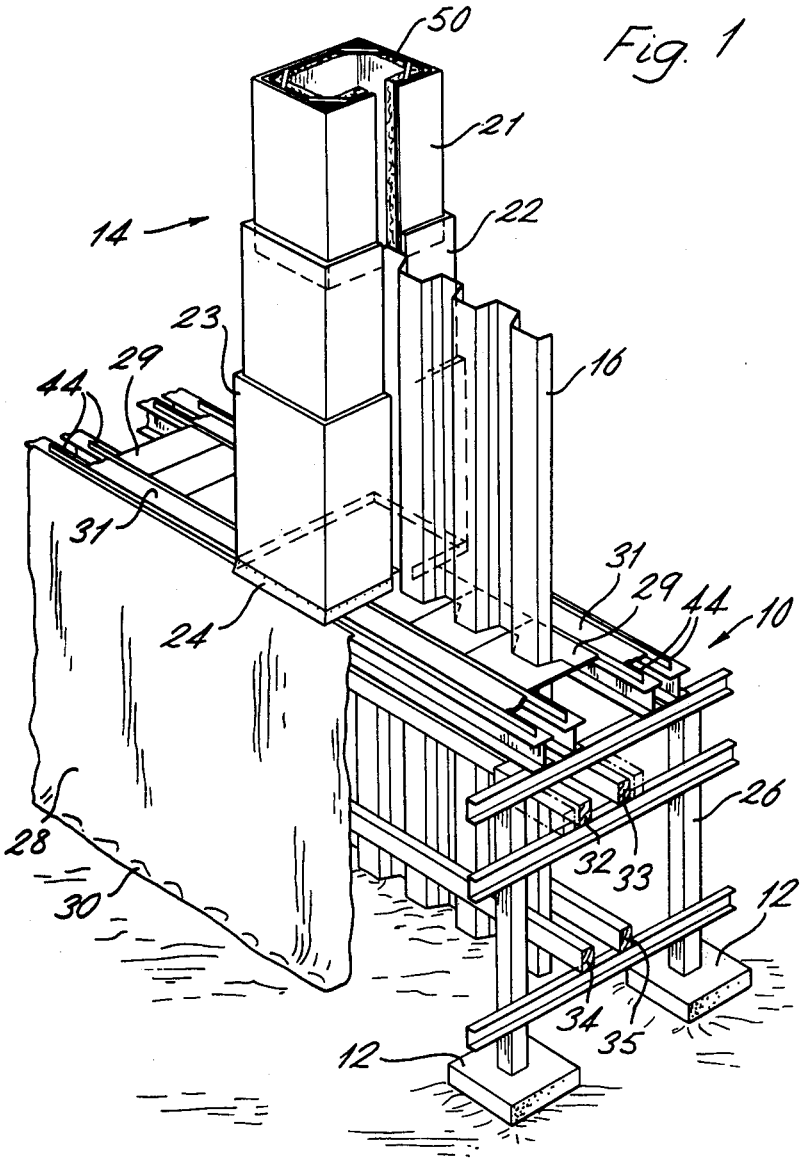
FIG. 1 shows a somewhat simplified perspective view of a rig according to the invention.

Referring first to FIGS. 1 and 2, the rig includes a first sound-reducing enclosure 10 standing on four ground-supported kelly blocks 12. A telescopic second sound-reducing enclosure 14 is mounted for lateral movement along the top of the first enclosure. Reference numeral 16 indicates sheet piling conventionally pitched to form a wall or panel as shown.

The top enclosure 14 is open-ended and the leading face of the enclosure includes spring loaded doors 18, 19 (omitted from FIG. 1). This allows the top enclosure to embrace the end of the wall 16. Although not apparent from FIG. 1 the three modules (21, 22, 23) of the top enclosure carry co-operating end flanges which can engage one another so that each module is capable of supporting the one below it. A sound-insulating skirt 24, such as Revertex Sound Barrier Mat Type JPT 060, secured to the lower edge of the top enclosure 14 encapsulates the carriages 42 hereinafter described with reference to FIG. 3. If desired, the bottom module can also carry a flange at its lower end in case an extra module is to be added e.g. for longer piles than previously.

The enclosure is held expanded by a rope from a light navy crane (not shown) attached to lifting points at the top ends of module 21. The crane also supports an air hammer (not shown) resting on top of a pile or a pair of piles within the enclosure.

The bottom enclosure 10 includes a largely conventional framework 26, surrounded by a sound insulating skirt 28 which has a weighted hem section 30 engaging the ground to give a good acoustic seal. A suitable material for the skirt would be Revertex Sound Barrier Mat Type JPT 060, for example, weighted down at the hem section with kentledge.

In their undriven position, the piles 16 are held upright by two pairs of beams 32 to 35 supported on the framework 26 within the bottom enclosure. In this embodiment, these beams provide the gates referred to earlier. The beams of at least the top pair of beams are preferably horizontally displaceable to the positions indicated in chain-dot lines in FIG. 1 to allow the piling hammer to pass between them if it is desired to drive the top of the piles below the level of these beams. It will be appreciated that by the time it is necessary to separate top beams 32, 33 in this way, the piles will be sufficiently into the ground to make support of these beams unnecessary.

The arrangement is completed by rails 44 carried by I-beams on the top of the lower enclosure and by a decking 29, 31 of rigid sound insulating material such as plywood board. The decking seals off the opening remaining in the top surface of the lower enclosure after the piles 16 and the upper enclosure 14 have been put in position. The central board 29 of the decking are made in sections, each section width being equal to one traverse of the upper enclosure. As shown in FIG. 1, ahead of the upper enclosure, these decking boards are cut to shape to provide a good fit around the piles whilst behind the upper enclosure (and beyond the row of piles if desired), the central decking boards are provided by single pieces.

It will be observed that in the arrangement illustrated in FIG. 1, the row of piles extends practically the whole length of the top enclosure but of course the piles must leave enough free track at either end to support the top enclosure there when the hammer is engaging the first and last piles of the row.

The operation of the rig is described below with reference to FIG. 1 which shows the situation where the upper enclosure 14 is about to begin a traverse. Assuming the situation shown in FIG. 1, the piling hammer is operated to drive down the pile or piles engaged by the hammer to just above the level of the top beams 32, 33. It will be appreciated that the hammer will sit on top of the piles throughout the driving operation so that its only motion will be downwards movement allowed by the piles as they are driven into the ground. The enclosure 14 will also collapse at the same rate until it reaches its fully collapsed position when the three modules lie wholly one within the other. The pile engaged by the springloaded doors referred to earlier is a later pile in the wall than the pile or piles engaged by these doors as the top enclosure is collapsed during driving.

When the first piles have been driven down as far as possible with beams 32, 33 in place, the navy crane is used to raise the hammer and to place it on the next pile or piles to be driven.

When this has been done, the decking 29 associated with the forthcoming traverse is removed and the top enclosure (still in its fully collapsed state) is moved to the next piles to be driven. The space exposed by this movement of the top enclosure is now covered by single-piece decking 29. During this traversing motion of the top enclosure, the doors 18, 19 are free to move first one way and then the other against the biasing action of springs 38, 39 as different parts of the pile profiles are engaged. The crane next expands enclosure 14 back to its original height and the driving procedure described above can then be repeated.

Subsequent piles in the row are dealt with in exactly the same way so that at the end of its first traverse, the piling hammer has driven all the piles enclosed by the bottom enclosure down to just above the level of the top beams 32, 33.

If it is now desired to drive the piles further into the ground, the top beams are separated to allow the hammer to pass. Then with the top enclosure in its fully collapsed position (and with the doors 18, 19 now closing against one another as shown in FIG. 2), the enclosure retraverses the row of piles in the reverse direction with the hammer driving in the piles to their new depth as it moves along from one location to the next with the enclosure.

One of the advantages of the rig of the present invention is therefore that it can be used to achieve a near continuous piling operation from the pitched height to the desired level and from end to end of the wall section.

With the driving operation for this section of the piling completed, the three modules of the top enclosure are locked together by a shute bolt (not shown) to hold the enclosure in its fully collapsed condition. The top enclosure is then removed (this time by using lifting points at the top end of the centre module 22) and so too is the air hammer. The bottom enclosure can now be reassembled around the next section of piling enabling the rest of the rig to be set up and operated as before. Dismantling and transport present no especial problem since the total weight of the rig is only some four tons or so.

Further details of the rig, described above mostly in general terms, will be apparent from FIGS. 2 and 3. Thus FIG. 3 shows a perspective view of a carriage 42 which is one of four such carriages supporting the four corners of the top enclosure 14. In position, each carriage (not visible in FIG. 1) will engage rails 44 carried by I-beams on the top of the lower enclosure.

FIG. 2 shows more clearly the detailed structure of the top enclosure. Each module comprises a rigid C-shaped portion (46) closed by the pair of sliding doors 18, 19. The height of the modules is about 2.5 meters and their plan dimensions vary from 2 × 1.6 meters for the inner module (21) to 2.6 × 2.2 meters for the outer one (23).

As far as its construction is concerned, the C-shaped part of the inner module is formed from a hollow section steel framework internally clad with a steel skin. To this skin are welded a number of inwardly projecting pins 48 which carry additional sound proofing 50 (also visible in FIG. 1). In the illustrated embodiment, this latter takes the form of a wrapping fabric 51 filled with fibre glass 52.

The C-shaped parts of the other two modules also include a hollow section steel framework but the internal skin is omitted and the framework is externally clad instead with a sound insulating material such as Revertex Sound Barrier Mat Type JPT 060. Blocks of sound-reducing material e.g. polyurethane foam sheets are secured to the inner surface of the cladding in the spaces left between different members of the framework.

The doors of the three modules are all made of plywood and carry at their inside edges rubber sealing strips 54, 55 which will compress slightly when they engage a pile. The doors are mounted on runner assemblies (not shown) each of which comprises a U-shaped first member secured to the leading face of the module, a second member of inverted U-shape secured to the door itself, and a number of roller wheels trapped between the two members to allow the doors to slide easily from one position to another. If desired, the doors can be opened and locked open by a simple system of ropes and pulleys (not shown).

Angle guides 57 welded to the corner edges of modules 22, 23 extend upwardly from the bottom two modules by an amount equal to their height. These guides are faced with strips 58 of a low friction material (such as Nylatron). Nylon pads 59 secured to spacer plates 60 at the corner points of modules 21, 22 against the guides prevent excessive lateral movement when the enclosure is being telescoped up or down.

Although an air hammer has been referred to in the specific description, it will be appreciated that any other suitable type of pile driving hammer could be used instead. Especially suited are those that do not require leaders e.g. pneumatic hammers, and steam or diesel driven hammers. Nor is the usefulness of the invention restricted to the case where the piles are to be driven — it is equally useful when they are to be extracted and at least in its broader aspects, references to driving and to pile drivers should not be taken as limiting the invention to exclude its application to pile extraction techniques. It should also be understood that the term "pile" is not to be narrowly interpreted. The rig of the present invention is of course able to accept piles of a wide range of types and cross-sections. It should also be borne in mind that the rig could be used to drive or extract members other than piles is so desired.

We claim:

1. For use in a piling process, a rig comprising a first sound-reducing pile enclosure of generally elongate shape with its length disposed horizontally, an upper surface to said first enclosure defining a pile-accepting aperture, a second sound-reducing enclosure having a pile-accepting aperture at the bottom thereof, and mounting means for mounting said second enclosure over said first enclosure, said mounting means being horizontally movable with said second enclosure along said upper surface of said first enclosure.

2. A rig as claimed in claim 1 including a track on said upper surface of said first enclosure, said track determining the line of motion of the mounting means and the second enclosure relative to the first enclosure.

3. A rig as claimed in claim 1 including two doors in the second enclosure, and biasing means urging said doors together.

4. A rig as claimed in claim 1 in which the second enclosure is vertically collapsible.

5. A rig as claimed in claim 4 in which the second enclosure has a telescopic construction.

6. A rig as claimed in claim 5 in which the uppermost module of the telescopic construction is additionally sound-proofed as compared with the other modules of the construction.

7. A rig as claimed in claim 1 including, within the volume of the first enclosure, support means for supporting a row of sheet piling at the desired inclination during at least the topmost part of the motion of the individual piles in the row.

8. A rig as claimed in claim 7 in which the rig is symmetrical about a vertical center plane and the support means comprises a pair of support gates arranged one on each side of said plane, said support gates being movable towards and away from that plane.

9. A rig as claimed in claim 8 in which there are at least two pairs of said support gates, the upper pair of support gates being sufficiently separable to allow the pile driver to pass between them.

* * * * *